US005573375A

United States Patent [19]

Barcza

[11] Patent Number: 5,573,375

[45] Date of Patent: Nov. 12, 1996

[54] TURBINE ENGINE ROTOR BLADE PLATFORM SEALING AND VIBRATION DAMPING DEVICE

[75] Inventor: William K. Barcza, Palm City, Fla.

[73] Assignee: United Technologies Corporation, Hartford, Conn.

[21] Appl. No.: 355,576

[22] Filed: Dec. 14, 1994

[51] Int. Cl.[6] ..... F01D 5/26

[52] U.S. Cl. ..... 416/193; 416/190

[58] Field of Search ..... 416/190, 193 A, 416/221, 500

[56] References Cited

U.S. PATENT DOCUMENTS

| | | | |
|---|---|---|---|
| 2,846,184 | 8/1958 | Tournere | 416/221 |
| 3,112,915 | 12/1963 | Morris | 253/77 |
| 3,266,770 | 8/1966 | Harlow | 253/39.15 |
| 3,610,778 | 10/1971 | Suter | 416/210 |
| 3,666,376 | 5/1972 | Damlis | 416/219 |
| 3,709,631 | 1/1973 | Karstensen et al. | 416/95 |
| 3,751,183 | 8/1973 | Nichols et al. | 416/220 |
| 3,887,298 | 6/1975 | Hess et al. | 416/220 |
| 4,101,245 | 7/1978 | Hess et al. | 416/193 A |
| 4,182,598 | 1/1980 | Nelson | 416/193 A |
| 4,280,795 | 7/1981 | Trousdell | 416/218 |
| 4,347,040 | 8/1982 | Jones et al. | 416/190 |
| 4,422,827 | 12/1983 | Buxe et al. | 416/193 A |
| 4,455,122 | 6/1984 | Schwartzmann et al. | 416/190 |
| 4,494,909 | 1/1985 | Forestier | 416/190 |
| 4,505,642 | 3/1985 | Hill | 416/193 A |
| 4,516,910 | 5/1985 | Bouiller et al. | 416/193 A |
| 4,568,247 | 2/1986 | Jones et al. | 416/190 |
| 4,872,810 | 10/1989 | Brown et al. | 416/145 |
| 4,872,812 | 10/1989 | Hendley et al. | 416/190 |
| 5,156,528 | 10/1992 | Bobo | 416/190 |
| 5,228,835 | 7/1993 | Chlus | 416/193 A |
| 5,261,790 | 11/1993 | Dietz et al. | 416/193 A |
| 5,284,421 | 2/1994 | Chlus et al. | 416/500 |
| 5,302,085 | 4/1994 | Dietz et al. | 416/220 R |
| 5,313,786 | 5/1994 | Chlus et al. | 60/39.75 |
| 5,415,526 | 5/1995 | Mercadante et al. | 416/500 |

*Primary Examiner*—Edward K. Look
*Assistant Examiner*—Mark Sgantzos
*Attorney, Agent, or Firm*—Richard D. Getz

[57] ABSTRACT

An apparatus for sealing a gap between adjacent rotor blades of a turbine engine rotor assembly and for damping vibrations of the rotor blades is provided. The apparatus comprises a platform seal and a damping block. The damping block is independent of the platform seal and includes apparatus for coupling the platform seal and the damping block. The damping block selectively acts against adjacent rotor blades of the turbine engine rotor assembly, forward of the platform seal, and therefore does not interfere with the platform seal. The coupled damping block and platform seal may be installed in the rotor disc prior to installation of the adjacent rotor blades in the disc, thereby obviating the need to blindly install the platform seal.

7 Claims, 3 Drawing Sheets

TURBINE ENGINE ROTOR BLADE PLATFORM SEALING AND VIBRATION DAMPING DEVICE

The invention was made under a U.S. Government contract and the Government has rights herein.

BACKGROUND OF THE INVENTION

1. Technical Field

This invention applies to turbine engine rotor assemblies in general, and to apparatus for sealing between adjacent rotor blades and for damping the vibration within a turbine engine rotor assembly in particular.

2. Background Information

Turbine and compressor sections within an axial flow turbine engine generally include a rotor assembly comprising a rotating disc and a plurality of rotor blades circumferentially disposed around the disc. Each rotor blade includes a root, an airfoil, and a platform positioned in the transition area between the root and the airfoil. The roots of the blades are received in complementary shaped recesses within the disc. The platforms of the blades extend laterally outward and collectively form a flow path for the fluids passing through the turbine. A person of skill in the art will recognize that it is a distinct advantage to control the passage of fluid from one side of the platforms to the other side of the platforms via gaps between the platforms. To that end, it is known to place a seal between the blade platforms to control such fluid leakage.

During the operation of the turbine engine, the rotor assemblies rotate at a variety of speeds through fluids that vary in temperature, pressure, and density. As a result, the blades may be excited into vibrating relative to the disc. Unchecked vibrating rotor blades can negatively affect not only the performance of the engine, but also the allowable life of the components.

A person of skill in the art will recognize that it is known to provide means for damping the vibratory motion of rotor blades within a turbine engine rotor assembly. In some embodiments, the damping means also acts as the seal between the platforms. A possible disadvantage to this approach is that the optimum sealing material may not be an optimum damping material. Hence, the performance of either or both functions may be compromised. In other embodiments, the damping means and the seal means are independent of one another. The damping means is positioned to act against the root-side surface of the platform and the sealing means is slid in under the platforms, between the damping means and the platforms. A disadvantage of this approach is that often the seal must be installed blindly after adjacent blades are installed in the disc. Seals which are slid in blindly require guiding means, usually in the form of additional surfaces cast in the rotor blade. In sum, what is needed is a means for damping vibrations in a turbine engine rotor assembly and a means for sealing between adjacent rotor blades which overcomes the aforementioned disadvantages.

DISCLOSURE OF THE INVENTION

It is, therefore, an object of the present invention to provide a means for damping vibrations in a turbine engine rotor assembly.

It is another object of the present invention to provide a means for sealing between adjacent rotor blades.

It is still another object of the present invention to provide a damping means and a sealing means that facilitates assembly of the turbine engine rotor assembly.

It is still another object of the present invention to provide a sealing means that helps prevent incorrect installation of the sealing means.

It is still another object of the present invention to simplify the shape of each cast turbine engine rotor blade.

It is still another object of the present invention to reduce the mass of each cast turbine engine rotor blade.

It is still another object of the present invention to reduce the number of stress rising geometric features of each cast turbine engine rotor blade.

It is still another object of the present invention to provide a turbine engine rotor blade damping means whose installed position is independent of the airfoil of each rotor blade.

According to the present invention, an apparatus for sealing a gap between adjacent rotor blades of a turbine engine rotor assembly and for damping vibrations of the rotor blades is provided. The apparatus comprises a platform seal and a damping block. The damping block is independent of the platform seal and includes means for coupling the platform seal and the damping block. The damping block selectively acts against adjacent rotor blades of the turbine engine rotor assembly, forward of the platform seal, and therefore does not interfere with the platform seal. The coupled damping block and platform seal may be installed in the rotor disc prior to installation of the adjacent rotor blades in the disc, thereby obviating the need to blindly install the platform seal.

An advantage of the present invention is that the installation of the seal between adjacent blades and the means for damping blade vibration is greatly facilitated.

Another advantage of the present invention is that the correct installation of the seal between adjacent blades is facilitated. Specifically, blind installation of the seal is eliminated and means is provided for properly positioning the seal.

Still another advantage of the present invention is that damping means and seal means disclosed enable the shape of each cast rotor blade to be simplified. A "cleaner" casting costs less to cast and is easier to later machine. Furthermore, the damping and seal means of the present invention obviate the need for additional surfaces for the damper to act against or for guiding the seal. As a result, each rotor blade has less stress risers. A person of skill in the art will recognize that it is a significant advantage to reduce the number of stress risers in a rotor blade and therefore increase the allowable life of the blade.

Still another advantage of the present invention is that the "cleaner" cast rotor blade of the present invention has less mass than many comparable cast rotor blades known in the prior art. The decrease in mass reduces the stress and strain to which the blade is subject.

Still another advantage of the present invention is that the forward position of the blade damping means is independent of the airfoil of each rotor blade. In most rotor blades, the convex side of the airfoil is closer to one edge of the platform. As a result, damping means designed to act in that region must either be shifted laterally to avoid the airfoil, or a pocket must be formed in the casting to receive the damping means. Either way, the rotor blade or the damping function is negatively effected.

These and other objects, features and advantages of the present invention will become apparent in light of the detailed description of the best mode embodiment thereof, as illustrated in the accompanying drawings.

BEST MODE FOR CARRYING OUT THE INVENTION

Figure 1:
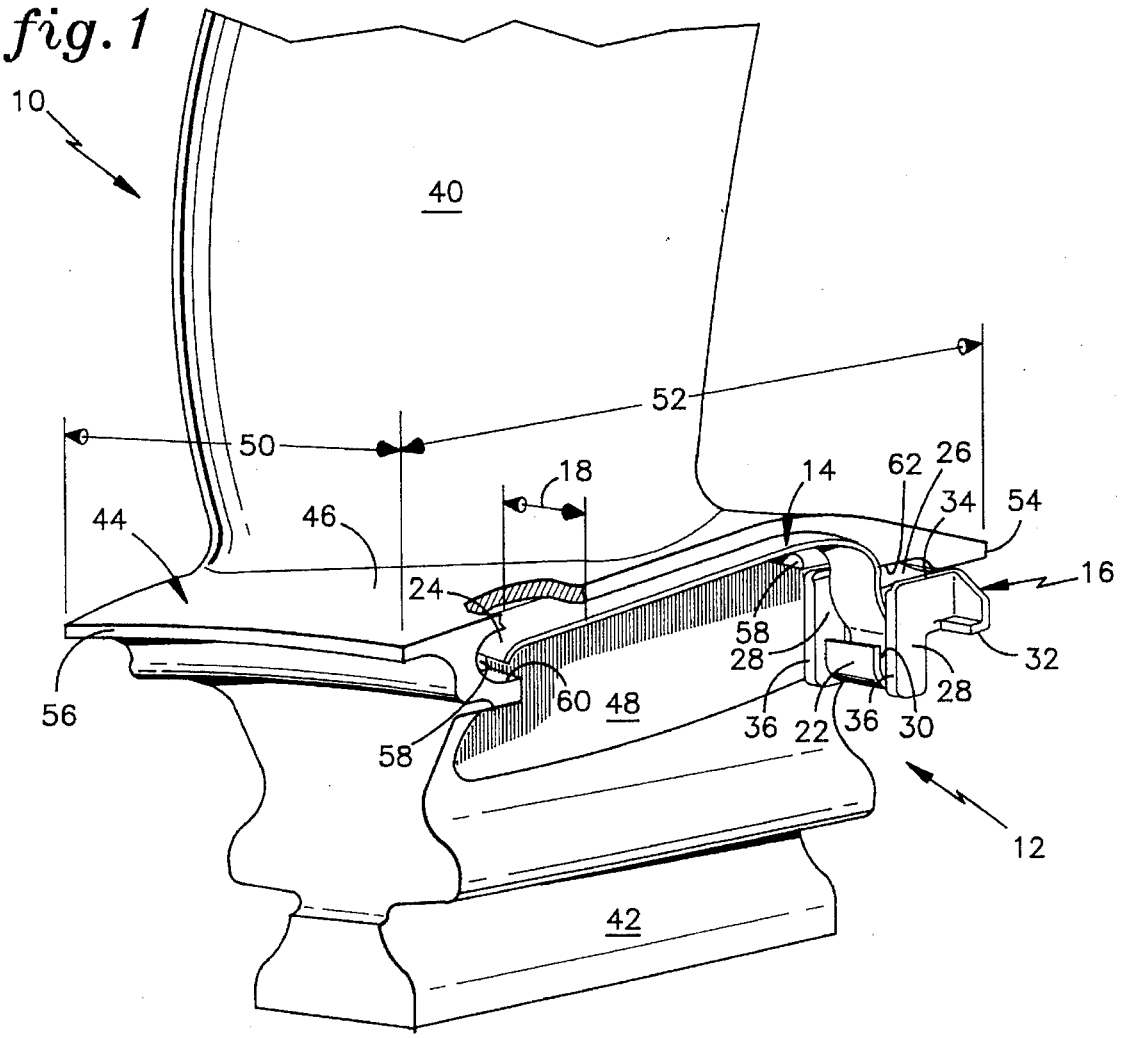
FIG. 1 is a perspective view of the seal and damper means of the present invention installed in a blade.

Referring to FIG. 1, a turbine blade 10 is shown with an apparatus 12 for: (1) sealing gaps between adjacent blades 10 of a turbine blade rotor assembly; and (2) damping vibrations of adjacent blades 10. The apparatus 12 includes a platform seal 14 and a damping block 16. The platform seal 14 comprises a thin plate body having a width 18, and a length defined by a first end 22 and a second end 24. The first end 22 of the platform seal 14 is formed into a hook shape.

Figure 2:
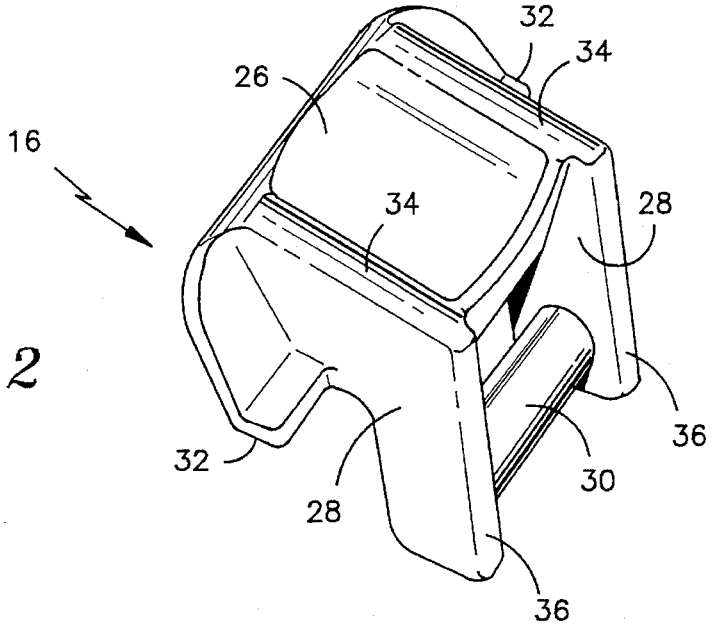
FIG. 2 is a perspective view of the damping block.

Referring to FIG. 2, the damping block 16 includes a body 26, a pair of flanges 28, a rod 30, and a windage surface 32. The body 26 includes a pair of friction surfaces 34 for contacting adjacent blades 10 (see FIG. 3). The flanges 28 are formed on opposite sides of the body 26 and each includes a section 36 extending out from the body 26. The rod 38 is fixed between the flange sections 36 extending out from the body 26. The windage surface is 32 formed on the forward side of the damping block as is shown in FIGS. 1 and 2. The windage surface 32 is contoured to direct air along a specific path within the turbine. Heretofore the damping block 16 has been described as being formed, but alternatively the block elements 26,28,30,32, may be made as individual pieces and assembled using conventional fastening means.

Referring to FIG. 1, each turbine blade 10 includes an airfoil 40, a root 42, and a platform 44. The platform 44 extends laterally outward in the transition area between the root 42 and the airfoil 40 and may be described as having an airfoil side 46, a root side 48, a width 50, and a length 52 extending from a forward edge 54 to a rearward edge 56. On each lengthwise side, the platform 44 includes a pair of locating surfaces 58, a seal pocket 60, and a damping shelf 62 for receiving a friction surface 34 of the damping block 16. The locating surfaces 58 extend laterally outward from the lengthwise sides of the blade 10, on the root side 48 of the platform 44. The seal pocket 60 is formed in the rearward portion of the platform 44, on the root side 48 of the platform 44, with the opening of the pocket 60 facing toward the forward edge 54. The damping shelf 62 is formed in the forward section of the platform 44, also on the root side 48.

Figure 3:
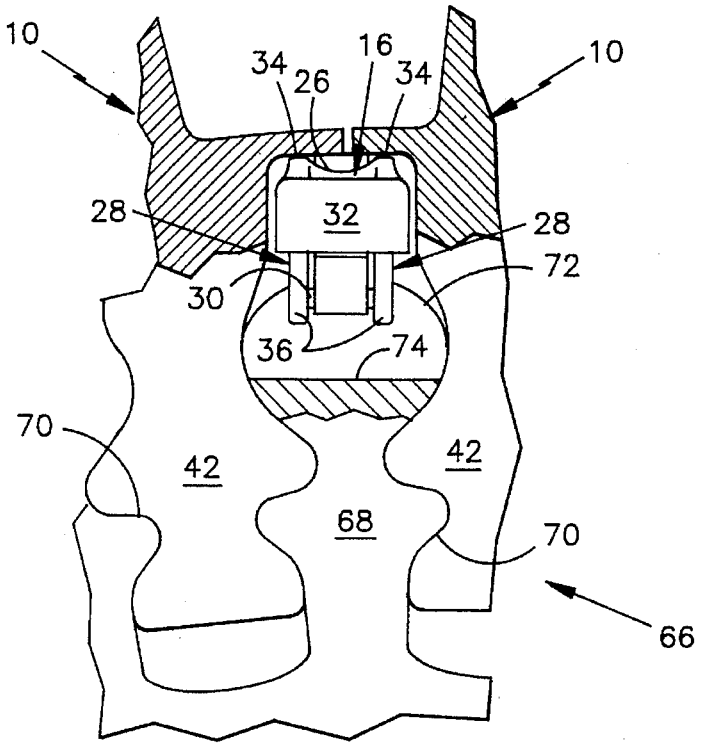
FIG. 3 is a sectional view of the blades and disc of a rotor assembly with the seal and damper means of the present invention installed between adjacent blades.
Figure 5:
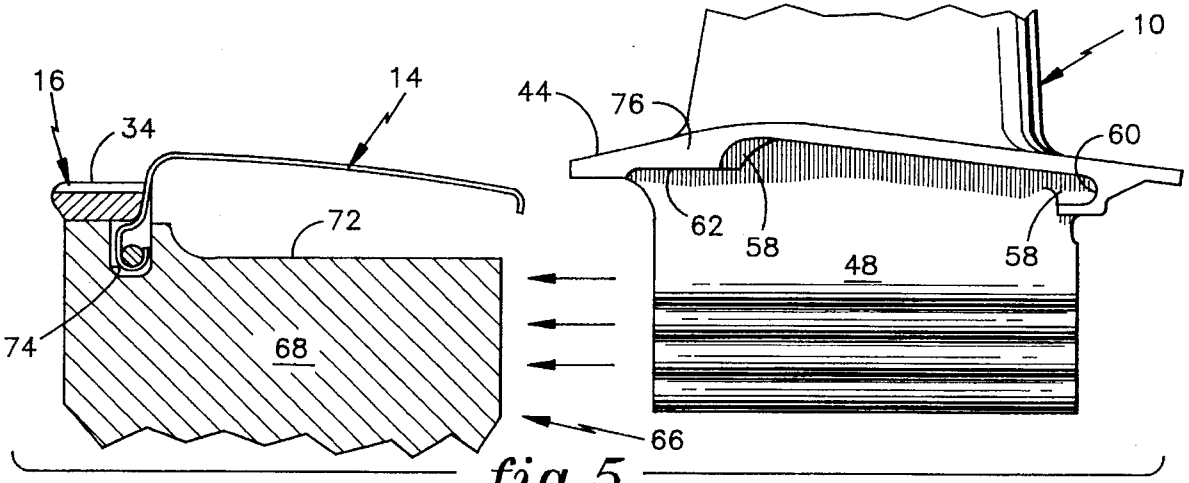
FIG. 5 illustrates the seal and damper means of the present invention mounted in a disc. The arrows indicate how the blade is assembled with the present invention installed in the disc.
Figure 6:
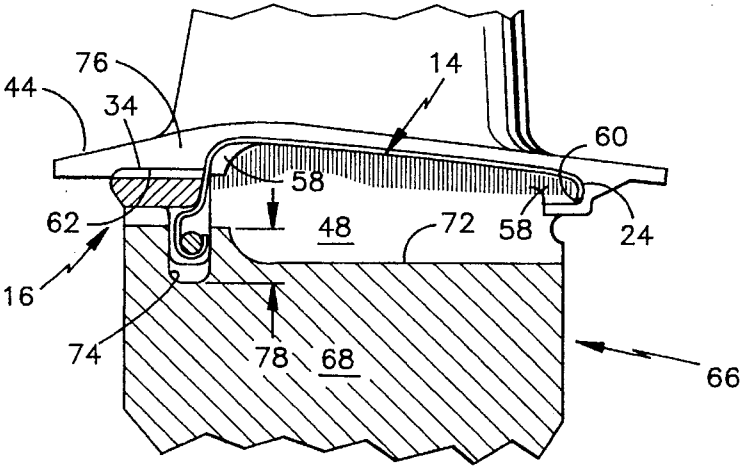
FIG. 6 is a sectional view of the blade and the seal and damper means of the present invention assembled with the disc.

Referring to FIG. 3, a section of a turbine blade rotor assembly 66 includes a pair of adjacent turbine blades 10 mounted in a disc 68. The disc 68 includes a plurality of recesses 70 circumferentially distributed in the outer surface 72 of the disc 68 for receiving the roots 42 of the turbine blades 10. FIG. 3 shows the roots 42 and recesses 70 having a conventional fir tree configuration. Other recess and root configurations may be used alternatively. The disc 68 further includes an annular slot 74 disposed in the outer surface 72 of the disc 68 for receiving damping blocks 16. FIGS. 5 and 6 show the annular slot 74 from a side view.

Figure 4:
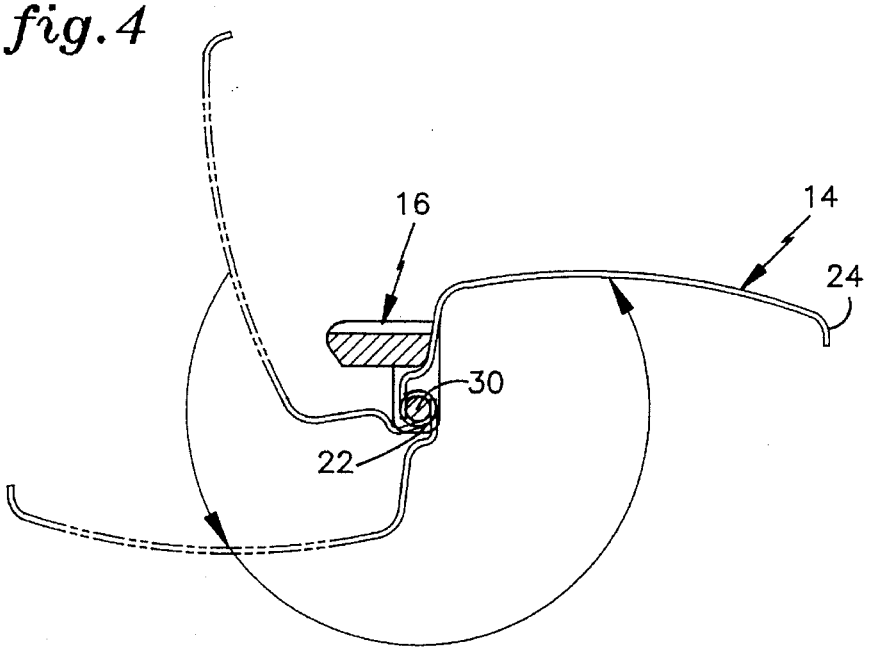
FIG. 4 illustrates how the seal and damper means are joined.

Referring to FIGS. 4–6, the turbine blade rotor assembly 66 may be assembled by first coupling the platform seals 14 and the damping blocks 16 as is shown in FIG. 4. The rod 30 of the damping block 16 is received within the hook-shaped first end 22 of the platform seal 14 and the seal 14 is rotated into a position where the damping block 16 prevents the seal 14 and block 16 from disengaging. Complementary pairs other than the hook and rod disclosed heretofore may be used alternatively.

A first turbine blade 10 is installed in the disc 68. The coupled platform seal 14 and damping block 16 are placed within the annular slot 74 of the disc 68 and slid laterally into engagement with the installed blade 10. Specifically, the second end 24 of the platform seal 14 is received within the seal pocket 60 and the platform seal 14 is slid into contact with the lateral locating surfaces 58. At this point: (1) the second end 24 of the platform seal 14 is maintained in a particular radial position by the seal pocket 60; (2) the weight of the damper block 16 maintains the first end 22 of the platform seal 14 and the damper block 16 at the lowest radial position within the annular slot 74 (Shown in FIG. 4); and (3) the lateral locating surfaces 58 maintain approximately one-half of the width 18 (see FIG. 1) of the platform seal 14 laterally outside the lengthwise side edge 76 of the platform 44. The depth 78 of the annular slot 74 permits the coupled platform seal 14 and damping block 16 to be in place and yet not interfere with the installation of the adjacent turbine blade. The lateral location of the locating surfaces 58 ensures that approximately one half of the platform seal 14 will be exposed to the adjacent blade. The adjacent blade is subsequently slid into position, over the exposed platform seal 14. The seal pocket 60 of the first blade 10 maintains the second end 24 of the platform seal 14 in the proper position to be received by the seal pocket 60 of the adjacent blade. The installation process described heretofore is repeated for every turbine blade 10.

Referring to FIG. 6, after installation is complete and the turbine blade rotor assembly 66 is rotated within the turbine engine (not shown), centrifugal forces force the coupled damper block 16 and platform seal 14 to translate radially outward into contact with the turbine blades 10, as is shown in FIGS. 3 and 6. Specifically, the friction surfaces 34 of each damper block 16 contact the damping shelves 62 of adjacent turbine blades 10 and the platform seal 14 contacts the root side 48 of the platform 44, thereby sealing the gap between the blades 10. The mass of the damping block 16 and the centrifugal force applied thereto are imposed on each blade platform 44 in a direction substantially normal to the damping shelf 62 of the platform 44. As a result, vibratory motion of the blades 10 is resisted by the frictional force between the damping blocks 16 and the platforms 44.

Although this invention has been shown and described with respect to the detailed embodiments thereof, it will be understood by those skilled in the art that various changes in form and detail thereof may be made without departing from the spirit and scope of the claimed invention. As an example, the best mode of the present application has been heretofore described in terms of a turbine blade and disc assembly. The present turbine engine rotor assembly damping and seal means is equally applicable to compressor applications within a gas turbine engine.

I claim:

1. A turbine blade, comprising:

a root, having means for attaching said blade to a disc;

an airfoil; and a platform, extending outward from said blade in a transition area between said root and said airfoil, said platform having:

a length;

a width; and a seal pocket, for receiving an end of a platform seal;

wherein said seal pocket maintains said platform seal in a position to be received by an adjacent blade during assembly, and thereby prevent misalignment of said platform seal.

2. A turbine blade according to claim 1, further comprising;

a damping shelf, for receiving a friction surface of a damping means, wherein said damping shelf is formed in a forward section of said platform.

3. A rotor assembly for an axial flow turbine engine, comprising:

(1) a plurality of blades, each blade including a root;

an airfoil; and a platform, extending laterally outward between said root and said airfoil;

(2) a disc, having an outer surface including a plurality of recesses, circumferentially distributed, for receiving said blade roots, an annular slot disposed in said outer surface, and a rotational axis about which said rotor assembly may be rotated; and (3) a plurality of platform seals, each seal having a first end and a second end; and (4) a plurality of damping blocks, each said damping block coupled with one of said platform seals;

wherein each said coupled damping block and platform seal may be positioned within said slot to permit installation of an adjacent blade in said disc without interference from said coupled damping block and platform seal; and wherein rotating said rotor assembly causes said damper to translate radially outward within said slot and act against said adjacent blades, forward of said platform seal.

4. A rotor assembly according to claim 3, wherein said damping blocks act against said platforms of said adjacent blades substantially forward of said airfoils.

5. A rotor assembly according to claim 3, wherein each of said blades further comprises:

a seal pocket, for receiving said first end of one of said platform seals;

wherein said seal pocket maintains said platform seal in a position to be received by said adjacent blade during assembly, and thereby prevent misalignment of said platform seal.

6. A rotor assembly according to claim 3, wherein each of said blades further comprises:

pair of surfaces, located between said root and said platform, extending outwardly in the lateral direction on each side of said blade, wherein said surfaces laterally locate said platform seal between said adjacent blades during assembly, and maintain said platform seal between said adjacent blades after said assembly; and a seal pocket, for receiving said first end of one of said platform seals;

wherein said seal pocket maintains said platform seal in a position to be received by said adjacent blade during assembly, and thereby prevent misalignment of said platform seal.

7. A rotor assembly according to claim 6, wherein said damping blocks act against said platforms of said adjacent blades substantially forward of said airfoils.

* * * * *